US008269596B2

(12) United States Patent
Staylor

(10) Patent No.: US 8,269,596 B2
(45) Date of Patent: Sep. 18, 2012

(54) UNIVERSAL DUAL STUD MODULAR FUSE HOLDER ASSEMBLY FOR BUSSED AND NON-BUSSED POWER CONNECTIONS

(75) Inventor: John Lawrence Staylor, Tualatin, OR (US)

(73) Assignee: Cooper Technologies Company, Houston, TX (US)

( * ) Notice: Subject to any disclaimer, the term of this patent is extended or adjusted under 35 U.S.C. 154(b) by 271 days.

(21) Appl. No.: 12/646,253

(22) Filed: Dec. 23, 2009

(65) Prior Publication Data

US 2011/0148564 A1 Jun. 23, 2011

(51) Int. Cl.
*H01H 85/20* (2006.01)
*H01H 85/48* (2006.01)

(52) U.S. Cl. ..... 337/229; 337/161; 337/186; 337/187; 337/227; 337/191; 337/235; 337/236

(58) Field of Classification Search ..... 337/191, 337/235, 256, 161, 186, 187, 227, 229
See application file for complete search history.

(56) References Cited

U.S. PATENT DOCUMENTS

| | | | | | |
|---|---|---|---|---|---|
| 1,455,566 | A * | 5/1923 | Briggs | 337/256 |
| 4,692,835 | A * | 9/1987 | Setoguti et al. | 361/104 |
| 5,088,940 | A * | 2/1992 | Saito | 439/620.34 |
| 5,620,337 | A * | 4/1997 | Pruehs | 439/508 |
| 5,643,693 | A * | 7/1997 | Hill et al. | 429/121 |
| 5,700,165 | A * | 12/1997 | Harris et al. | 439/620.26 |
| 6,294,978 | B1 * | 9/2001 | Endo et al. | 337/166 |
| 6,456,188 | B1 * | 9/2002 | Tsuchiya | 337/235 |
| 6,509,824 | B2 * | 1/2003 | Inaba et al. | 337/295 |
| 6,512,443 | B1 * | 1/2003 | Matsumura et al. | 337/189 |
| 6,902,434 | B2 * | 6/2005 | Stack | 439/620.28 |
| 6,985,065 | B2 * | 1/2006 | Aguila | 337/235 |
| 7,347,733 | B2 * | 3/2008 | Murakami | 439/620.27 |
| 7,429,906 | B2 * | 9/2008 | Korczynski | 335/6 |
| 7,663,466 | B1 * | 2/2010 | Jetton | 337/191 |
| 7,978,046 | B2 * | 7/2011 | Ohashi et al. | 337/186 |
| 2005/0122203 | A1 * | 6/2005 | Jur et al. | 337/159 |

* cited by examiner

*Primary Examiner* — Anatoly Vortman
(74) *Attorney, Agent, or Firm* — Armstrong Teasdale LLP

(57) ABSTRACT

Modular fuse holders include dual studs with stepped configuration allowing the fuse holders to be universally used with and without bus bars while ensuring proper connection of a fuse.

18 Claims, 6 Drawing Sheets

UNIVERSAL DUAL STUD MODULAR FUSE HOLDER ASSEMBLY FOR BUSSED AND NON-BUSSED POWER CONNECTIONS

BACKGROUND OF THE INVENTION

The field of the invention relates generally to fuse holders, and more specifically to modular fuse holders having terminal stud connections.

Fuses are overcurrent protection devices for electrical circuitry, and are widely used to protect electrical power systems and prevent damage to circuitry and associated components when specified circuit conditions occur. A fusible element or assembly is coupled between terminal elements of the fuse, and when specified current conditions occur, the fusible element or assembly melts or otherwise structural fails and opens a current path between the fuse terminals. Line side circuitry may therefore be electrically isolated from load side circuitry through the fuse, preventing possible damage to load side circuitry from overcurrent conditions.

Some known fuse holders are provided in modular form that may be assembled into larger fuse blocks. A pair of terminal studs are sometimes provided in each of such modular fuse holders for electrical connection to line side and load side circuitry, with a fuse completing a circuit path between the pair of fusible studs. Bus bars, which may be sold with the modular fuse holders or separately provided, are sometimes desirable to connect one power supply, for example, across a number of fuse holders while providing separately fused output power connections. Known fuse holders of this type are subject to certain difficulties and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Exemplary embodiments of modular fuse holders and assemblies are described herein that overcome numerous disadvantages in the art.

Figure 1:
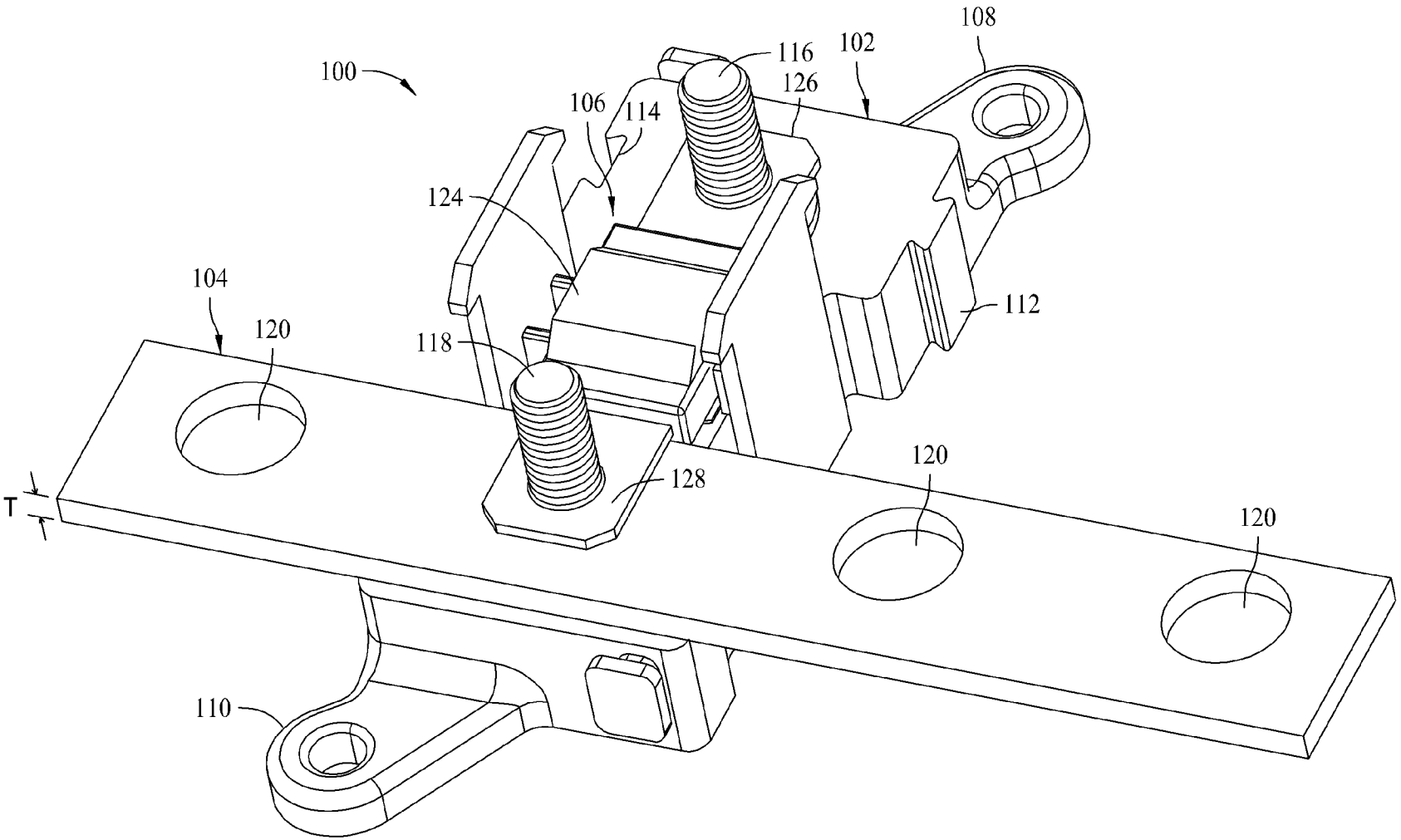
FIG. 1 is a perspective view of an exemplary modular fuse holder with a fuse and bus bar attached.

FIG. 1 is a perspective view of an exemplary modular fuse holder assembly 100 including a modular body 102, a bus bar 104, and a fuse 106.

Figure 5:
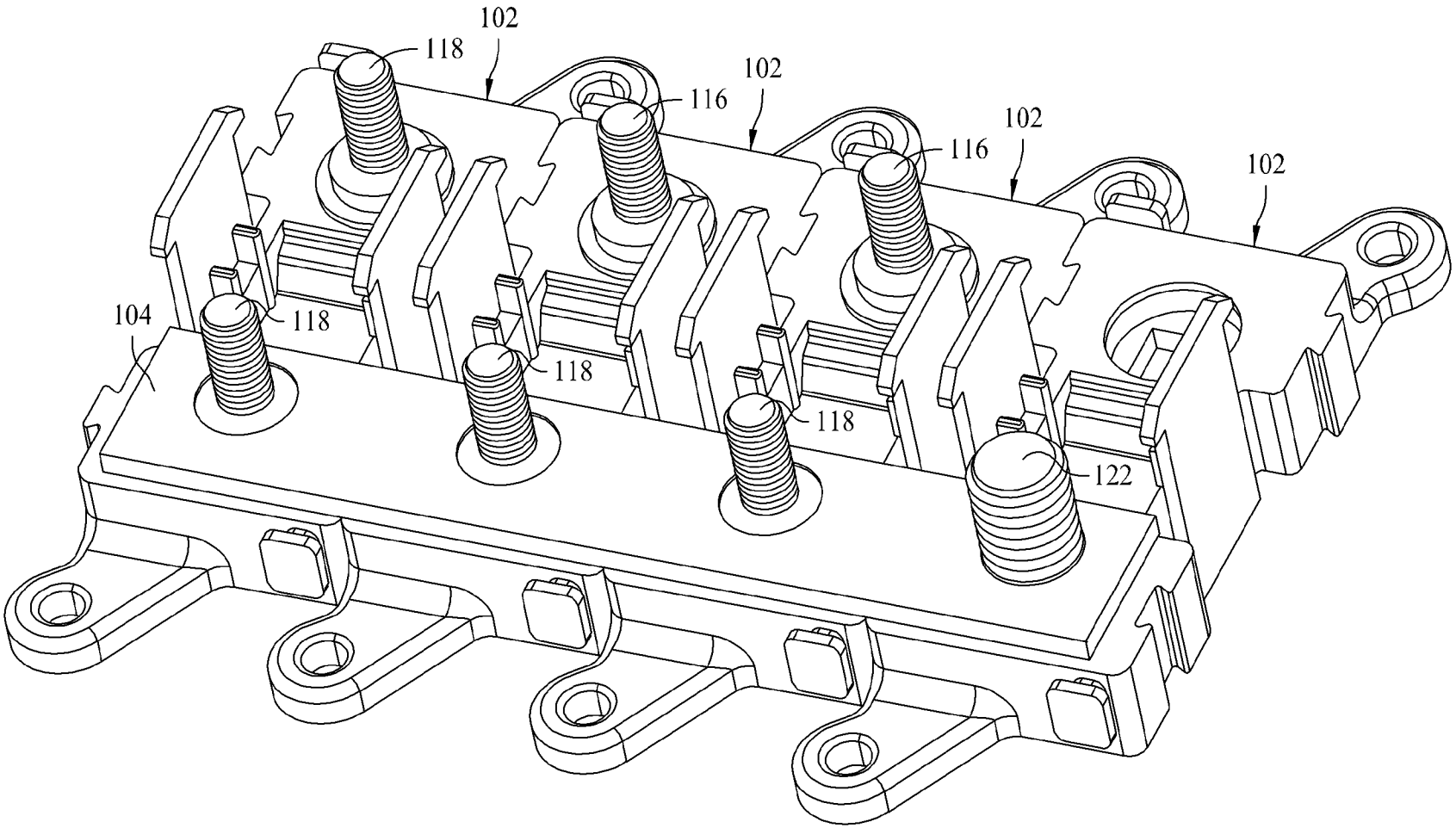
FIG. 5 is a perspective view of a first exemplary arrangement of fuse holders as shown in FIG. 1 ganged together and forming a fuse block.
Figure 6:
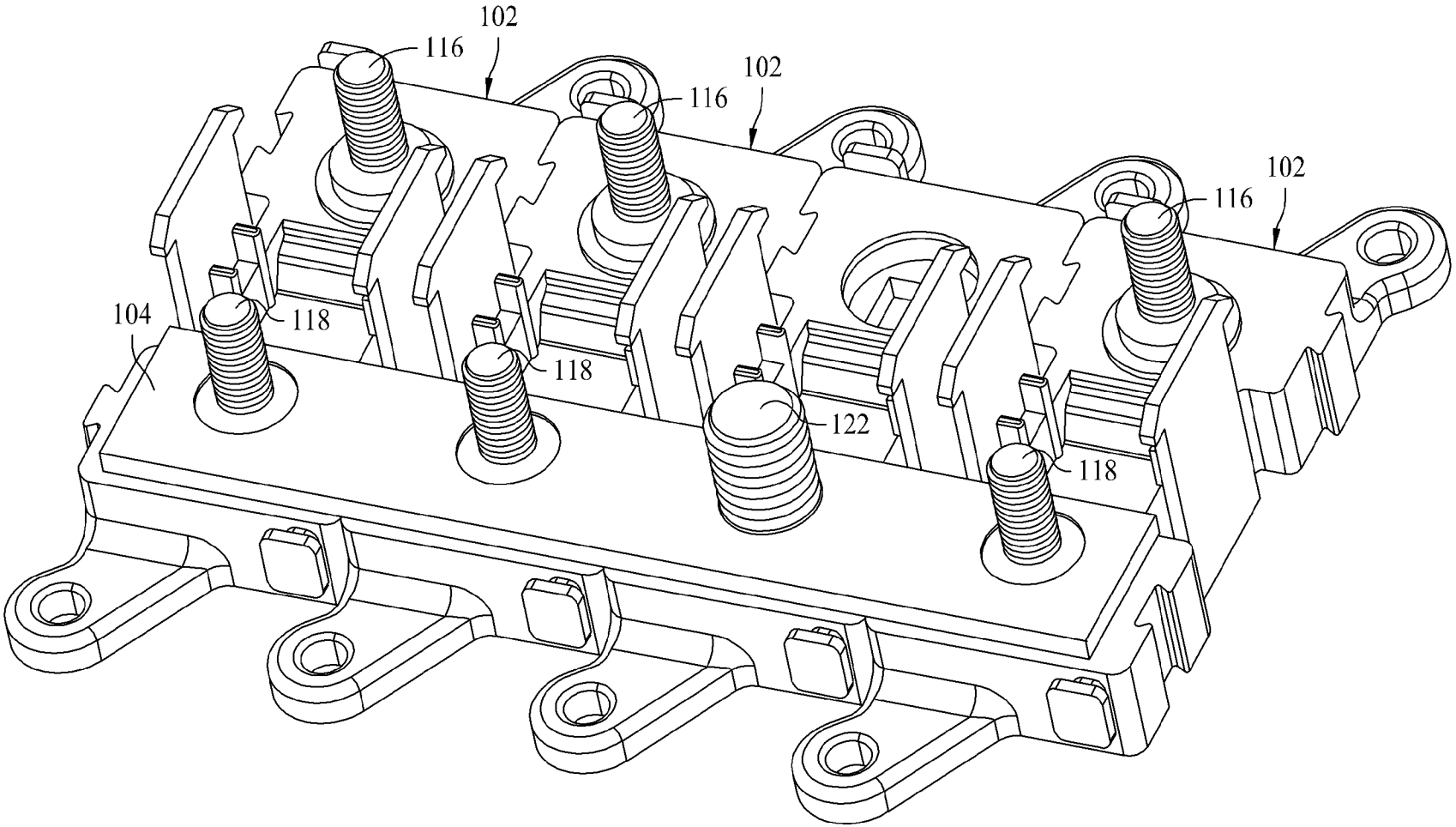
FIG. 6 is a perspective view a second exemplary arrangement of the fuse holders shown in FIG. 5.

The body 102 is fabricated from a known insulative or nonconductive material using known processes. In one embodiment, the body 102 may be fabricated from an injection molded, heavy duty plastic material. It is understood, however, that other suitable processes and materials are known in the art and may likewise be utilized to fabricate the body 102. In the embodiment shown, the body 102 is generally rectangular in form and includes diametrically opposed mounting lugs 108, 110 allowing the body 102 to be mounted on, for example, a chassis of a vehicle or other supporting structure. Additionally, and as shown, the exemplary body 102 includes one or more projections 112 and slots 114 that allow multiple bodies 102 to be coupled or ganged together to form a larger fuse block as shown in the examples of FIGS. 5 and 6. The projections 112 and slots 114 interlock with one another with sliding engagement and are sometimes referred to as "dovetail" latching features.

The body 102 further includes first and second terminal studs 116 and 118 projecting therefrom and arranged as a pair opposing one another. One of the studs 118 may be electrically connected to power supply circuitry, sometimes referred to as a line side connection, and the other stud 116 may be electrically connected to electrical loads and circuitry receiving electrical power from the line side, sometimes referred to by those in the art as a load side connection. The fuse 106 may be connected to the line and load side terminal studs 118, 116, respectively as further described below to provide fusible protection for circuitry completed to the studs 116, 118. The line side and load side connections may be established in a known manner using, for example, ring terminals and the like coupled to the studs 116, 118. The body 102 including the studs 116, 118 is provided as a module that may be used alone or in tandem with other modules as desired to provide one or more fused power connections in, for example, a vehicle electric power system or other electrical power system. Any number of modules may be assembled to form a larger fuse block as shown in the examples of FIGS. 5 and 6.

Figure 3:
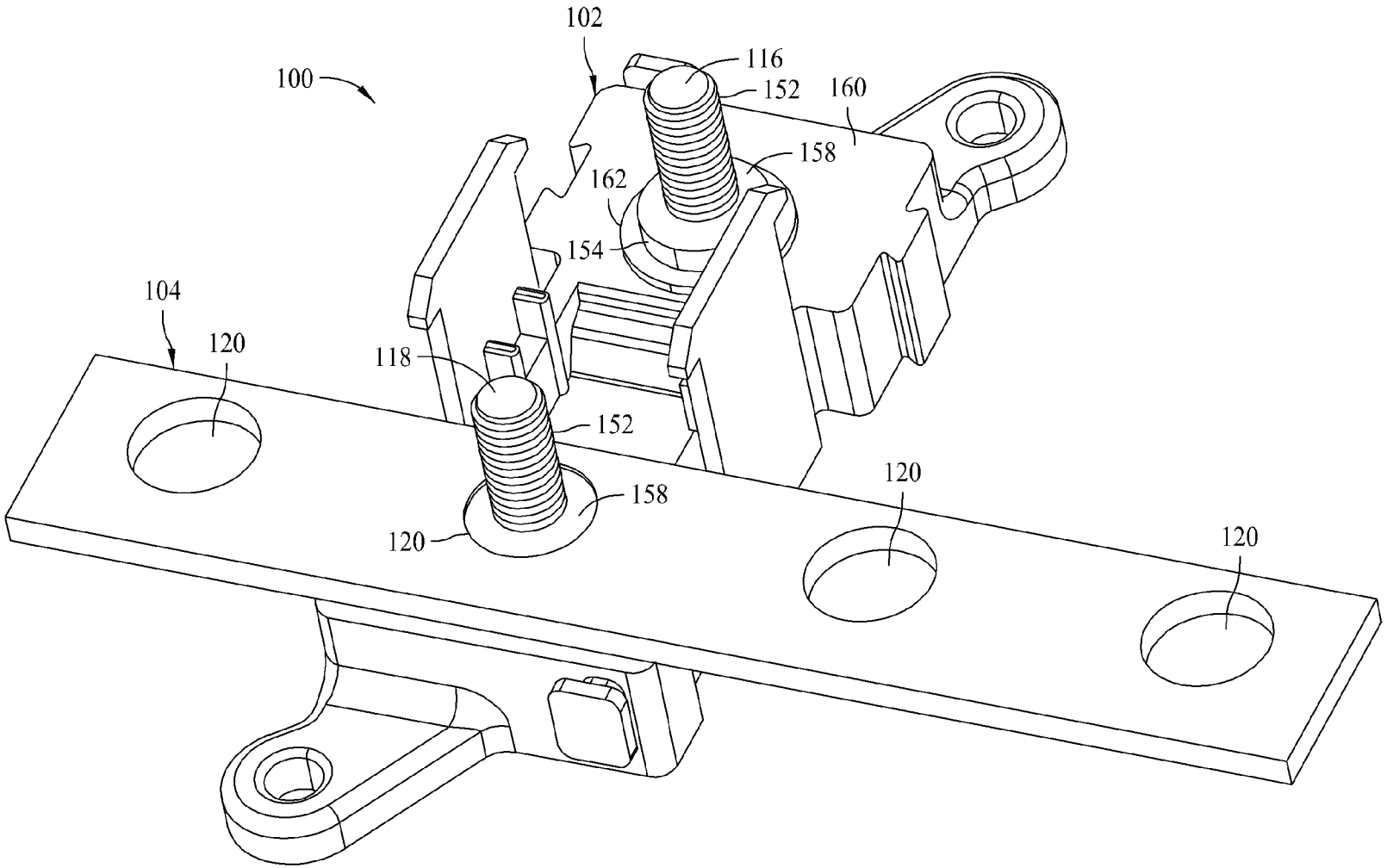
FIG. 3 is a view similar to FIG. 1 but with the fuse removed.

The bus bar 104, as shown in the example depicted, may be a generally flat and planar element fabricated from a conductive material such as metal (e.g., copper or another metallic material familiar to those in the art) or a conductive alloy familiar to those in the art and utilizing known processes. The bus bar 104 in the illustrated embodiment is provided with a plurality of equally sized (i.e., equal diameter as shown) and spaced apart holes 120 (three of which are visible in FIG. 1 and a fourth of which is fitted over the terminal stud 118 as best seen in FIG. 3). Thus, in the exemplary embodiment depicted, the bus bar 104 may connected to a power input terminal 122 (FIGS. 5 and 6) via one of the holes 120 and three other modular fuse holders having bodies 102 and terminal studs 116 and 118 as shown in FIGS. 5 and 6 and explained further below. As such, all of the terminal studs 118, for example may be electrically connected to one power supply via the input terminal 122 and the bus bar 104. Alternatively, the bus bar 104 could be connected to the load side terminal studs 116 and the load side terminals could be connected to a plurality of power supplies or power supply circuitry.

While a bus bar having four holes 120 is shown in the exemplary embodiment, it is understood that the bus bar 104 may alternatively be provided with greater or fewer numbers of holes 120 to accommodate a greater number (e.g., seven in another embodiment) or a fewer number of modular fuse holders including a body 102 and the terminal studs 116 and 118. A wide variety of differently configured fuse blocks having varying numbers of modular fuse holders may therefore be provided in addition to those shown in FIGS. 5 and 6. The bus bar 104 may be provided together with the appropriate number of modular fuse holders, or alternatively may be separately provided.

The fuse 106 in the illustrated embodiment is a known overcurrent protection fuse such as AMI fuse or AMG fuse of Cooper Bussmann, St. Louis Mo., although it shall be understood that other fuses of various other manufactures may likewise be utilized. The fuse 106 includes a nonconductive housing 124 and conductive terminal elements 126, 128 extending from opposed ends of the housing 124. A fuse element, fusible link or fuse element 130 (FIG. 3) is connected to and extends between the terminal elements 126 and 128 and is further contained within the housing 124. In normal operating conditions, the fuse element, link or assembly 130 is a conductive or current carrying element and completes a circuit path between a line side power supply via the terminal element 128 (and terminal stud 118) to load side circuitry via the terminal 126 (and the terminal stud 116).

In abnormal operating conditions, however, the fuse element, link or assembly 130 is constructed to structurally fail and open the current path between the fuse terminals 126, 128. The fuse element, link or assembly 130 can be strategically selected to fail at a predetermined location in the housing 124 when predetermined current conditions occur via weak spots in a fuse element or other features known to those in the art. The predetermined current conditions causing the fuse element 130 to fail is typically selected to be a current level that is below an amount that would result in damage to downstream circuitry, devices or components in the load side circuitry. The predetermined current conditions causing the fuse element, link or assembly 130 to fail also corresponds to the rating of the fuse. Various ratings are possible and the fuse element, link or assembly 130 may be designed for different voltages and current conditions appropriate for the line and load side circuitry. As the fuse element, link or assembly 130 structurally fails when specified conditions occur, the fuse element, link or assembly 130 becomes incapable of conducting current and an open circuit between the fuse terminals 126 and 128 results. The line side circuitry connected to the terminal stud 118 is consequently electrically isolated from the load side circuitry connected to the stud 116. Potential damage to load side circuitry from excess currents in the line side circuitry is therefore reliably avoided.

Figure 2:
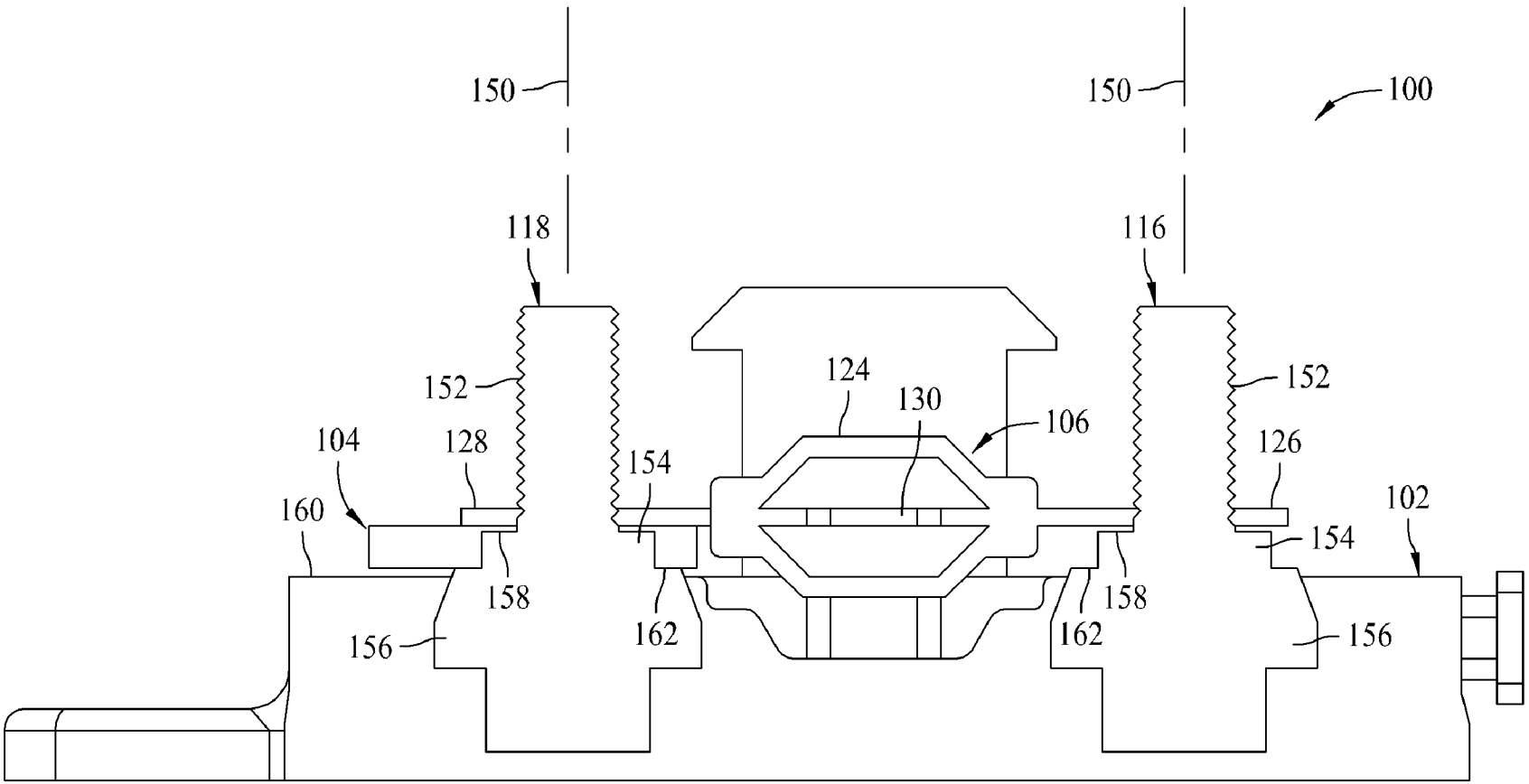
FIG. 2 is a sectional view of the assembly shown in FIG. 1.

As shown in the embodiment of FIGS. 1 and 2, the fuse terminal elements 126, 128 are each substantially planar blade-type terminal elements, and each includes a respective opening or hole 132, 134 (FIG. 4) allowing the terminal elements 126, 128 to be fitted over the terminal studs 116, 118. The fuse terminal elements 126, 128 may be secured to the respective studs 116, 118 with fasteners such as nuts coupled to the threaded studs 116, 118. The fuse 104 can therefore be effectively bolted in place on the body 102, which is especially desirable for vehicle electrical power systems and the like that are subject to mechanical shock and vibration in use.

The presence of a bus bar on one side of the assembly 100 (sometimes referred to as the bus side), but not on the other side of the assembly 100 (sometimes referred to as the non-bus side) can present certain problems in fuse holders of this kind. Specifically, the thickness T (FIG. 1) of the bus bar on the bus side may cause the fuse terminal on the bus side to sit higher than the fuse terminal on the non-bus side. As such, the fuse terminals may actually extend at an angle relative to the bus bar and each of the terminal studs. If the fuse terminals are tightened down with nuts on the respective terminals studs 116, 118 in such a condition, the fuse terminal elements 126, 128 and/or the fuse element, link or assembly 130 in the fuse 106 would be subjected to mechanical stress and bending forces that can cause them to distort. Depending on the magnitude of the resultant stress and distortion, the performance of the fuse may be impaired, leading to potential reliability issues or even shorter life of the fuse.

One potential solution to such concerns is to develop somewhat customized and specifically designed modular fuse holders for use with or without bus bars. For example, fuse holders designed specifically for use with bus bars may include modified insulative bodies so that the bus bar sits lower on the bus side. Incidentally, if such a specialized fuse holder designed for use with a bus bar is (intentionally or unintentionally) used without the bus bar, similar issues to those described above will result because the fuse will again sit at an undesirable angle to the terminal studs. In such a case, instead of the fuse terminal on the bus bar side sitting higher than the opposite fuse terminal as discussed above, the fuse terminal on the bus bar side would sit lower than the fuse terminal on the non-bus bar side.

Specifically designed fuse holders for use with and without bus bars tends to increase production costs of providing the fuse holders, as well as presents a possibility of human error when selecting or installing them. Proper inventories of modular fuse holders and bus bars must be inventoried and distinguished by manufacturers, distributors, and installers. If a fuse holder of one type (e.g., one designed for use with a bus bar) is ordered, supplied or installed by mistake and actually used without a bus bar, it can be difficult to detect and somewhat costly to correct after the fact, especially if such mistakes are repeated throughout one or more electrical systems. Installation of the fuse holders can become more costly and time consuming if the proper fuse holders and bus bars are not present when needed in the field.

The difficulties noted above are overcome with the fuse holder assembly 100, as will now be explained in relation to the sectional view of FIG. 2. As seen in FIG. 2, the terminal studs 116, 118 have a stepped configuration that allows the fuse terminals 126 and 128 to sit flat and level with the insulative body 102, and generally perpendicular to a longitudinal axis 150 of the respective terminal studs 116, 118 regardless of whether the bus bar 104 is used or not. The fuse terminals 126, 128 are therefore not placed in mechanical bending stress and subject to distortion when the fuse bar 104 is used on one side, but not the other. As such, the body 102 including the terminal studs 116, 118 may be universally used in applications requiring bus bars and applications that do not require bus bars. Advantageously, a single modular fuse holder including the body 102 and studs 116, 118 may therefore suffice for both purposes, and because the fuse terminals 126, 128 are maintained in a proper position in either case, reliability issues of the fuse 106 in operation and potentially shorter fuse life that may otherwise result is avoided. Potential human error is installing the fuse holders is largely, if not completely, avoided.

As FIG. 2 shows, each of the first and second terminal studs 116, 118 includes a threaded terminal portion 152 having a first outer diameter measured from the central longitudinal axis 150 of each stud. The terminal studs 116, 118 also each include a bus bar receiving portion 154 having a second outer diameter larger than the first diameter of the threaded portions 152, and an anchor portion 156 having a third outer diameter than is larger than the second outer diameter of the bus bar receiving portions 154. The bus bar receiving portion 154 of each stud 116, 118 is generally cylindrical and defines a generally planar and annular fuse terminal receiving surface 158 (best seen in FIG. 3) proximate one end of the threaded portion 152. The fuse terminal receiving surfaces 158 of the studs 116, 118 are generally coplanar with one another, and extend in a plane perpendicular to the axes 150 of the studs, and also in a spaced relation to a plane of an upper major surface 160 of the insulative body 102.

Figure 4:
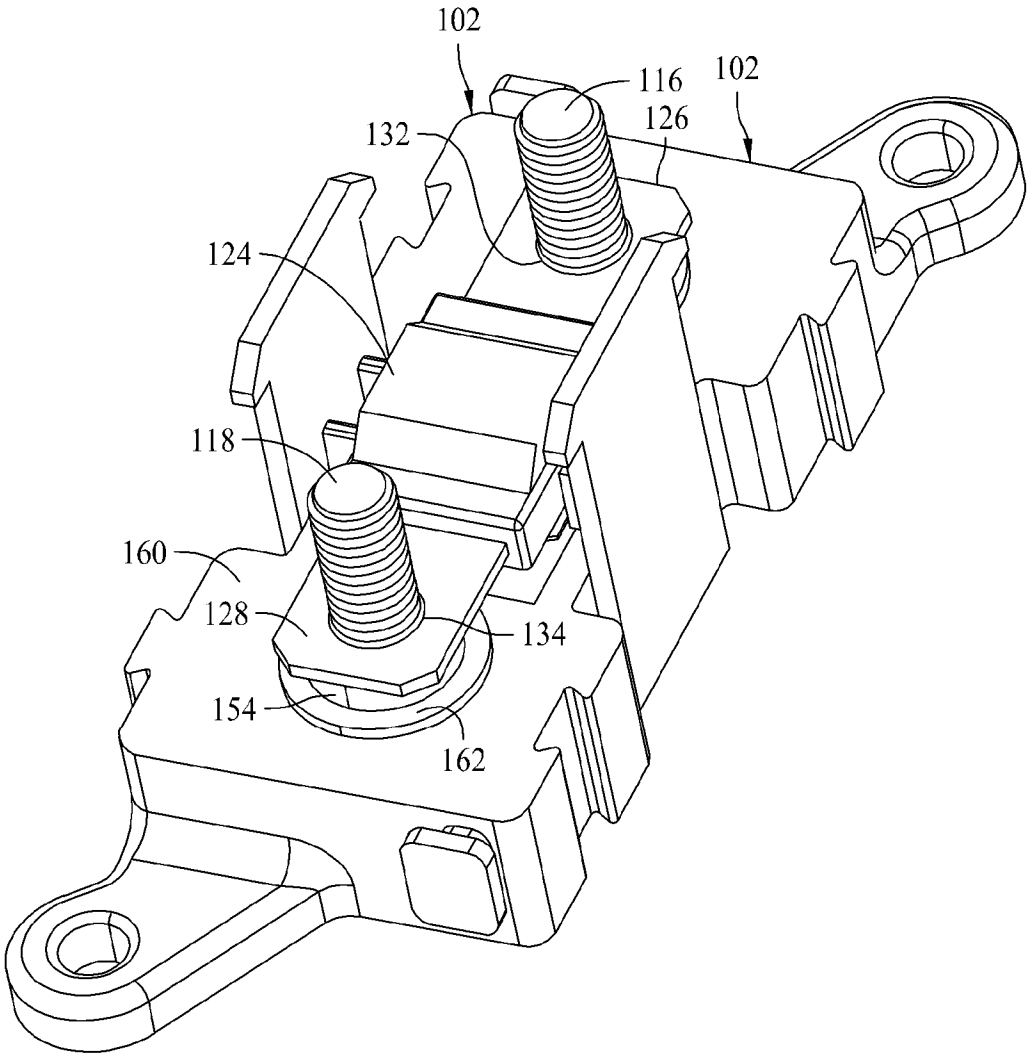
FIG. 4 is a view similar to FIG. 1 but with the bus bar removed.

The openings 132, 134 (FIG. 4) in the fuse terminals 126, 128 are slightly larger, but approximately equal to the outer diameter of the threaded portions 152 of the studs 116, 118, but smaller than the outer diameter of the bus bar receiving portions 154. As such, when the fuse terminal openings 126 are fitted over the terminal studs 116, 118, the fuse terminal receiving surfaces 158 form a generally flat and level shelf or stop surface for the fuse terminal to rest and seat upon. When the fuse terminals 126, 128 are tightened down with a nut, for example, and clamped to the fuse terminal receiving surfaces 158, bending stresses on the fuse terminals 126, 128 are avoided. This is true both when the bus bar 104 is present (FIGS. 1-3) as well as when the bus bar 104 is not present (FIG. 4).

The anchor portion 156 (FIG. 2) of each terminal stud 116, 118 is attached to the insulative body 102, and the bus bar receiving portions 154 and the threaded portions 152 project upwardly and away from the insulative 102 body such that the longitudinal axes 150 of the studs 116, 118 are spaced apart and generally parallel to one another such that the fuse 106 may be extended therebetween. In an exemplary embodiment, the anchor portion 156 also defines a generally planar and annular bus bar receiving surface 162 that is spaced from and generally parallel to the fuse terminal receiving surfaces 158. The bus bar receiving surface 162 of each stud 116, 118 is also slightly elevated from the upper surface 160 of the insulative body 102 adjacent the studs 116, 118. The bus bar receiving surfaces 162 of the stud 116, 118 extend generally coplanar to one another and in a second plane spaced from the plane of the fuse terminal receiving surfaces 158.

The planes of the bus bar receiving surfaces 162 and the fuse terminal receiving surfaces 158 are spaced apart in a direction parallel to the axes 150 of the studs 116, 118 by an amount approximately equal to the thickness T (FIG. 1) of the bus bar 104. As those in the art will understand, the planes of the bus bar receiving surfaces 162 and the fuse terminal receiving surfaces 158 may be spaced a slight distance shorter than bus bar thickness T to provide suitable tolerances for the assembly, but for practical purposes the spaced planes would still be considered approximately or substantial equal to the bus bar thickness. Beneficially, and because of the stepped terminal studs 116, 118 as described, no variation between the non-bused side and the bus side of the body 102 is required. The costs of providing the body 102 reduced compared to modified housings with variation between the bus and non-bus sides to accommodate a bus bar are avoided.

The openings 120 (FIGS. 1 and 3) in the bus bar 104 are sized to have a diameter slightly larger than, but approximately equal to, the outer diameter of the fuse receiving portions 154 of the studs 116, 118. As such, when the bus bar 104 is used, one of the bus bar openings 120 may be fitted over the stud 118 and closely fit or nest with the fuse receiving portions 154, with a lower surface of the bus bar resting or seating on the bus bar receiving surface 162 in a substantially level or horizontal orientation. That is, the bus bar 104 is maintained in a proper orientation relative to the studs 116, 118 to facilitate the fuse terminals 126, 128 being reliably clamped down on the bus bar 104. Mechanical and electrical connection via surface engagement of the conductive studs 116 and 118, the bus bar 104 and the fuse 106 is therefore ensured while substantially avoiding mechanical bending stress on any of the components.

As shown in the exemplary embodiment of FIG. 2, the third outer diameter of the anchor portion 156 is not constant along the axes 150 in a direction toward the body 102. Rather, the anchor portion 156 is tapered or flared such that its outer diameter increases in a direction parallel to the axis 150 and away from the bus bar receiving portion 154, imparting a bulb-like shape to the anchor portion 156. The flared anchor portion 156 provides an increased surface area for attachment to the body 102, and increases the structural strength and stability of the joined body 102 and terminal studs 116, 118. In one embodiment the body 102 may be injection molded around the anchor portions 156 of the studs 116, 118. In another embodiment the studs 116, 118 may be attached to the body 102 in another manner, including but not limited to threaded attachment and the like.

It is contemplated that the flared anchor portion 156 as shown and described, while believed to be beneficial for the reasons stated, may be entirely omitted in another embodiment if desired. In one such embodiment the bus bar receiving portion 154 may be further extended and attached to the insulative body 102, or as another example the anchor portion may be present but have a constant diameter (possibly even a reduced diameter) relative to the bus bar receiving portion 154 in each stud while still attaching to the insulative body 102.

In an exemplary but non-limiting embodiment, the holes 120 in the bus bar holes may be about 8 mm in diameter, while the openings 132, 134 (FIG. 4) in the fuse terminals 126, 128 may be about 6.5 mm. The threaded portions 152 of the terminal studs 116, 118 may include M5 metric threads. When the modular fuse holders are assembled into a larger blocks and connected with the bus bar 104 as shown in FIGS. 5 and 6, another body 102 may be provided but instead of including the studs 116, 118 including M5 threads in this example, the body may include the terminal input stud 122 (FIGS. 5 and 6) having, for example, larger diameter M8 metric threads. As can be seen in FIGS. 5 and 6, the larger diameter input stud 122 is approximately equal in diameter to the holes 120 in the bus bar 104, and consequently the input stud 122 substantially fills one of the openings 120 in the fuse bar 104. Of course, larger and smaller dimensions of the various diameters in the terminal stud portions and/or the openings in the fuse terminals or bus bar may likewise be utilized with equal effect.

Further, and also advantageously, because the openings 120 in the bus bar are equally sized, the bus bar 104 is substantially universal and the input stud 122 may be received in any of the openings 120 of the bus bar. That is, the input terminal stud 122 may be used with the bus bar in multiple positions in the larger block when coupled to other modular fuse holders as described, while the bus bar receiving portions 152 in the terminal studs 116, 118 substantially fill the other openings 120 in the bus bar 104. Specifically, the input terminal can be positioned in an end position as shown in FIG. 5 as well as a middle position between adjacent fuse holders with the studs 116, 118 as shown in FIG. 6. A great deal of flexibility is therefore provided for the benefit of an installer, unlike some known fuse holders and bus bars wherein the input terminal stud position is inflexibly limited to a specific position in the block, typically on one end of the block.

It should now be evident that the three modular fuse holders including the terminal studs 116 and 120 and the body including the input stud 122 renders it possible to arrange them in many different combinations, at least four of which include the input stud 122 being located in a different location on the block. As more fuse holders are included, the benefits of having multiple combinations and options for positioning the input stud are perhaps even more pronounced. It is also contemplated that other types of modules may further be provided and combined with modular fuse holders as described to provide even more options.

The benefits and advantages of the invention are now believed to amply demonstrated in connection with the exemplary embodiments described above. It is contemplated, however, that further variations are possible, and the basic concepts and methodology disclosed could be expanded to other types of bodies 102, bus bars 104 and fuses 106. For example, other shapes and configurations of housings may be utilized with other shapes and configurations of bus bars within the scope and spirit of the invention. As another example, the bus bar openings 120 need not be round, and other shapes and geometries may be utilized with complementary shapes and profiles in the bus bar receiving portions 154 of the studs 116, 118 within the scope and spirit of the invention. Those in the art would no doubt envision still other modifications and variations achieving substantially similar structure, functionality and/or resultant benefits in a substantially similar manner.

An embodiment of a modular fuse holder assembly has been disclosed including at least one insulative body, and first and second studs projecting from the body in a spaced apart and generally parallel relationship to one another. Each of the first and second studs includes a threaded terminal portion having a first outer diameter, and a bus bar receiving portion having a second outer diameter larger than the first diameter. The bus bar receiving portion defines a generally planar fuse terminal receiving surface proximate one end of the terminal portion.

Optionally, each of the fuse terminals may further include an anchor portion attached to the insulative body, and the anchor portion has a third outer diameter larger than the second outer diameter. The anchor portion may define a generally planar bus bar receiving surface spaced from and generally parallel to the fuse terminal receiving surface. A bus bar may also be provided, with the bus bar having a thickness, and the bus bar receiving surface and the fuse terminal receiving surface being spaced by an amount substantially equal to the thickness of the bus bar. The third outer diameter may not be constant along an axis of the anchor portion. The fuse terminal receiving surfaces of the first and second terminal studs are generally coplanar to one another.

Also optionally, the at least one insulative body may further be configured to receive a fuse between the first and second stud terminals. The fuse may include a nonconductive housing and first and second conductive terminal elements extending from the nonconductive housing. Each of the first and second conductive terminal elements may include an aperture having an outer diameter substantially equal to the first outer diameter, and the aperture in the first and second conductive element may be fitted over the respective first and second terminal stud with the terminal elements being seated upon the fuse terminal receiving surface when the fuse is installed. The first and second conductive terminals elements may each be generally planar, and may even be generally coplanar in an exemplary embodiment.

As still another option, a bus bar may be provided having a plurality of spaced apart holes extending therethrough, and each of the holes may be substantially equally sized and having an outer diameter substantially equal to the second outer diameter. The bus bar has a thickness, and the bus bar receiving portion in each of the first and second studs may extend for an axial distance approximately equal to the thickness. The bus bar may be a generally planar element. Another insulative body having a power input stud attached thereto may also be provided and ganged with the at least one insulative body, with the power input stud having an outer diameter approximately equal to the second diameter.

Optionally, the at least one insulative body may include a plurality of insulative bodies ganged together. Each of the plurality of insulative bodies may include first and second terminal studs, and the first terminal studs in each respective one of the plurality of bodies may be received in one of the holes in the bus bar. The insulative body having the power input stud may be ganged with the plurality of insulative bodies in any position relative to the plurality of insulative bodies wherein the power input terminal is receivable in one of the spaced apart holes in the bus bar. The second terminal stud in each respective one of the plurality of bodies may not be associated with a bus bar.

Another embodiment of modular fuse holder assembly has also been disclosed including a plurality of insulative bodies configured to be ganged to one another in a side-by-side arrangement to form a fuse block. One of the insulative bodies includes a power input stud attached thereto and the other of the insulative bodies each having a pair of terminal studs attached thereto. The power input terminal in the one insulative body has a first outer diameter and each of the pair of terminal studs in the other of the insulative bodies have threaded portions with a second outer diameter smaller than the first outer diameter. Each of the pair of terminal studs in the other of the insulative bodies further includes a bus bar receiving portion having an outer diameter approximately equal to the first outer diameter of the power input stud. The bus bar receiving portions each define a fuse terminal receiving surface spaced from the respective insulative bodies, whereby a fuse may be connected between each pair of terminal studs in the other of the insulative bodies with opposed terminal elements of the fuse maintained in contact with the fuse terminal receiving surface in spaced relation to the other of the insulative bodies.

Optionally, the fuse holder assembly may further include a bus bar having a plurality of spaced apart holes. The spaced apart holes may have an outer diameter approximately equal to the first diameter of the power input stud, and the power input stud may be received in one of the spaced apart holes and one of each of the pairs of the threaded stud terminal may be received in the other of the spaced apart holes. The bus bar may have a thickness, and the bus bar receiving portions of the terminal studs may extend for an axial distance in the terminal studs that is approximately equal to the thickness. The bus bar may be substantially planar.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A modular fuse holder assembly comprising:

at least one insulative body; and first and second terminal studs projecting from the at least one insulative body in a spaced apart and generally parallel relationship to one another;

wherein each of the first and second terminal studs comprises a threaded terminal portion having a first outer diameter, and a bus bar receiving portion having a second outer diameter larger than the first diameter, the bus bar receiving portion defining a generally planar fuse terminal receiving surface proximate one end of the terminal portion wherein each of the first and second terminal studs further includes an anchor portion attached to the insulative body, the anchor portion having a third outer diameter larger than the second outer diameter; and wherein the anchor portion defines a generally planar bus bar receiving surface spaced from and generally parallel to the fuse terminal receiving surface.

2. The modular fuse holder assembly of claim 1, further comprising a bus bar, the bus bar having a thickness, and the bus bar receiving surface and the fuse terminal receiving surface being spaced by an amount substantially equal to the thickness of the bus bar.

3. The modular fuse holder assembly of claim 1, wherein the third outer diameter is not constant along an axis of the anchor portion.

4. The modular fuse holder assembly of claim 1, wherein the at least one insulative body is further configured to receive a fuse between the first and second terminal studs, the fuse including a nonconductive housing and first and second conductive terminal elements extending from the nonconductive housing, each of the first and second conductive terminal elements including an aperture having an outer diameter substantially equal to the first outer diameter, and wherein the aperture in the first and second conductive element is fitted over the respective first and second terminal stud and the terminal elements being seated upon the fuse terminal receiving surface when the fuse is installed.

5. The modular fuse holder assembly of claim 4, wherein the first and second conductive terminals elements are each generally planar.

6. The modular fuse holder assembly of claim 5 wherein the first and second conductive terminal elements are generally coplanar.

7. The modular fuse holder assembly of claim 1, further comprising a bus bar having a plurality of spaced apart holes extending therethrough, each of the holes being substantially equally sized and having an outer diameter substantially equal to the second outer diameter.

8. The modular fuse holder assembly of claim 7, wherein the bus bar has a thickness, and the bus bar receiving portion in each of the first and second terminal studs extends for an axial distance approximately equal to the thickness of the bus bar.

9. The modular fuse holder assembly of claim 7, wherein the bus bar is a generally planar element.

10. The modular fuse holder assembly of claim 7, further comprising another insulative body having a power input stud attached thereto and ganged with the at least one insulative body, the power input stud having an outer diameter approximately equal to the second diameter.

11. The modular fuse holder assembly of claim 10, wherein the at least one insulative body comprise a plurality of insulative bodies ganged together, each of the plurality of insulative bodies including first and second terminal studs, and the first terminal studs in each respective one of the plurality of bodies being received in one of the holes in the bus bar.

12. The modular assembly of claim 11, wherein the insulative body having the power input stud is configured to be ganged with the plurality of insulative bodies in a plurality of different positions relative to the plurality of insulative bodies including first and second terminal studs, and wherein the bus bar is configured to receive the power input terminal in multiple ones of the spaced apart holes in the bus bar to accommodate the plurality of different positions.

13. The modular bus bar assembly of claim 11, wherein the second terminal stud in each respective one of the plurality of insulative bodies is not associated with a bus bar.

14. The modular assembly of claim 1, wherein the fuse terminal receiving surfaces of the first and second terminal studs are generally coplanar to one another.

15. A modular fuse holder assembly comprising:

a plurality of substantially identical insulative bodies configured to be ganged to one another in a side-by-side arrangement to form a fuse block, one of the substantially identical insulative bodies including a power input stud attached thereto and the other of the substantially identical insulative bodies each having a pair of terminal studs attached thereto, the power input stud in the one substantially identical insulative body having a first outer diameter and each of the pair of terminal studs in the other of the substantially identical insulative bodies having threaded portions with a second outer diameter smaller than the first outer diameter;

each of the pair of terminal studs in the other of the substantially identical insulative bodies further including a bus bar receiving portion having an outer diameter approximately equal to the first outer diameter of the power input stud, the bus bar receiving portions each defining a fuse terminal receiving surface spaced from the respective substantially identical insulative bodies;

whereby, when a fuse is connected between each pair of terminal studs in the other of the substantially identical insulative bodies with opposed terminal elements of the fuse maintained in contact with the fuse terminal receiving surface in spaced relation to the other of the substantially identical insulative bodies, an electrical connection is established from the power input stud to and through the fuse.

16. The fuse holder assembly of claim 15, further comprising a bus bar having a plurality of spaced apart holes, the spaced apart holes having an outer diameter approximately equal to the first diameter of the power input stud, and wherein the power input stud is received in one of the spaced apart holes and one of the terminal studs in each of the pairs of the terminal studs is received in the other ones of the spaced apart holes in the bus bar.

17. The fuse holder assembly of claim 16, wherein the bus bar has a thickness, and the bus bar receiving portions of each of the pairs of the terminal studs extend for an axial distance that is approximately equal to the thickness of the bus bar.

18. The fuse holder assembly of claim 16, wherein the bus bar is substantially planar.

* * * * *